US006767273B1

(12) United States Patent
Coverdale et al.

(10) Patent No.: US 6,767,273 B1
(45) Date of Patent: Jul. 27, 2004

(54) CRANKPIN GRINDING METHOD

(75) Inventors: Stephen Roger Coverdale, Shipley (GB); David Thomas Proctor, Skipton (GB); Christopher Shaun Thorpe, Crosshills (GB)

(73) Assignee: UNOVA UK Limited, Ayelsbury (GB)

( * ) Notice: Subject to any disclaimer, the term of this patent is extended or adjusted under 35 U.S.C. 154(b) by 0 days.

(21) Appl. No.: 10/111,640

(22) PCT Filed: Oct. 26, 2000

(86) PCT No.: PCT/GB00/04135

§ 371 (c)(1),
(2), (4) Date: Aug. 29, 2002

(87) PCT Pub. No.: WO01/30536

PCT Pub. Date: May 3, 2001

(30) Foreign Application Priority Data

Oct. 27, 1999 (GB) ..... 99253676
Oct. 28, 1999 (GB) ..... 99254872

(51) Int. Cl.[7] ..... B24B 49/00; B24B 51/00; B24B 1/00

(52) U.S. Cl. ..... 451/5; 451/7; 451/53; 451/62

(58) Field of Search ..... 451/5, 7, 49, 53, 451/62, 103, 214, 221, 342, 249, 251

(56) References Cited

U.S. PATENT DOCUMENTS 4,384,333 A * 5/1983 Maecker ..... 700/164
4,621,463 A * 11/1986 Komatsu et al. ..... 451/62
4,790,698 A * 12/1988 Heffron ..... 409/200
5,453,037 A * 9/1995 Lehmann ..... 451/5
5,919,081 A * 7/1999 Hykes et al. ..... 451/11

FOREIGN PATENT DOCUMENTS

EP 000903200 A1 * 3/1999
WO WO98/10891 * 3/1998

* cited by examiner

*Primary Examiner*—M. Rachuba
(74) *Attorney, Agent, or Firm*—Reising, Ethington, Barnes, Kisselle, P.C P.C.

(57) ABSTRACT

A method is described for grinding a crankpin of a crankshaft using computer controlled wheelfeed and headstock drives (44,30,24). During a final grinding step leading to finish size the cutting force is maintained on the wheelhead (38) to keep the wheel (34) and pin under a moderate constant load and the rotational speed of the headstock drive (24) is reduced. This serves to prevent bounce and chatter marks appearing in the surface of the pin. The rotational speed is typically in the range of 1 to 5 rpm. During the final step of grinding each pin, the wheelfeed is adjusted so as to remove a sufficient depth of material during a single rotation of the crankshaft, to bring the crankpin to finish size. In order to determine the depth of cut required, each pin is gauged

13 Claims, 1 Drawing Sheet

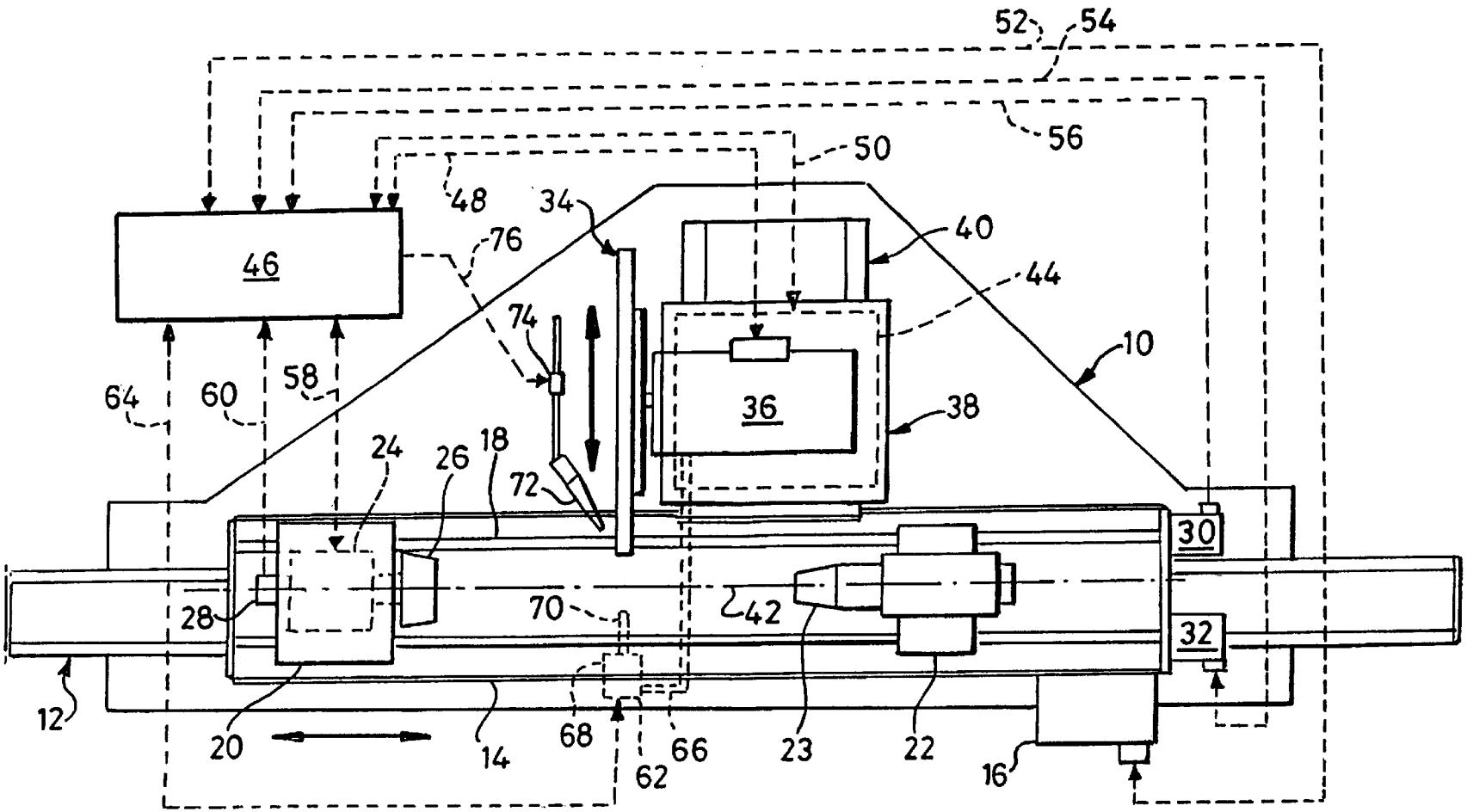
10
12
14
16
18
20
22
23
24
26
28
30
32
34
36
38
40
42
44
46
48
50
52
54
56
58
60
62
64
66
68
70
72
74
76

CRANKPIN GRINDING METHOD

FIELD OF THE INVENTION

This invention concerns the grinding of crank pins, especially an improved process of finish grinding such components particularly crankpins of steel crankshafts using a computer controlled grinding machine.

BACKGROUND TO THE INVENTION

For finish grinding the depth of stock to be removed is normally less than 0.5 mm on radius.

Crank pins are traditionally ground using a continuous feed method in which the rotating grinding wheel is fed into the workpiece by advancing the wheelhead, as the workpiece is rotated. The rate of wheel advance is usually decreased as the workpiece approaches finish size, once to size, sparkout using wheel dwell is performed. This normally consists of a few turns of the workpiece whilst the wheelhead (on which the rotating grinding wheel is carried) remains fixed in position relative to the workpiece, with the wheel just grazing the pin.

During the rest of the process, the wheelhead is advanced and retracted under computer control so as to maintain contact between wheel and crankpin as the latter is rotated around the crankshaft axis. The crankshaft is driven by a headstock drive.

A typical example of such a process in which 0.3 mm depth of material on the radius is to be removed, is as follows:

Rapid advance wheel until workpiece is 0.4 mm above size at a rate of 100 mm/s.

Fast feed the wheel to 0.07 mm above finish size at a rate of 70 $\mu$m/s.

Medium feed the wheel to 0.015 mm above finish size at a rate of 15 $\mu$m/s.

Slow feed the wheel to achieve finish size at a rate of 3.5 $\mu$m/s.

Dwell the wheel to maintain grazing contact to achieve sparkout during two or more rotations of the workpiece.

In such a process the normal workspeed will be 20 rpm for the early steps with a workspeed of 10 rpm sometimes used during slow feed and dwell to achieve sparkout.

Wheel material is typically CBN, and a typical wheel surface speed will be 115 m/s Wheel width can be as much as 42 mm Coolant is usually supplied at high pressure and with a high rate of flow to the region of wheel/workpiece engagement.

Problems Encountered with the Traditional Method

The traditional method has worked well when grinding crankpins of Cast Iron crankshafts, but problems have occurred when trying to grind similar components of steel, especially large steel crankshafts such as for 6 cylinder diesel engines, using CBN grinding wheels. The bigger the crank throw, the more the problems which have been encountered.

In particular, two effects have been noted.

1. Hydrodynamic Effect of Coolant. Due to the high pressure of the coolant applied to the region of contact between the workpiece and wheel, a hydrodynamic effect can occur. This tends to force the wheel and workpiece apart.

2. Workpiece deflections under grinding forces. When grinding with CBN wheels in particular, energy becomes stored in the wheel and the workpiece, due to the cutting force in particular, applied through the wheelhead and wheel to the crankshaft, and due to the stiffness of the latter. The result is to deflect the wheel and crankshaft being ground, by several microns. During sparkout, deflections produced in the wheel and workpiece part when under load, diminish, while the wheel is still in a position to remove any high points which appear as the workpiece relaxes. The procedure has usually ensured a relatively good finish size to the ground region.

However inter alia uneven wear of the wheel means that sparkout will not necessarily result in a cylindrically true component, and bounce and chatter marks have regularly been found after sparkout is completed.

The roundness and surface errors seem to be aggravated when using CBN wheels where separation forces are far higher than for example when using A10× grinding wheels. The stiffness of a CBN wheel is higher than that of an A10× wheel of similar size, and the amount of deflection produced when using a CBN wheel tends to be greater than when using an A10× wheel. These deflections, coupled with the hydrodynamic effect of high pressure coolant, have meant that during sparkout the grinding wheel has tended to bounce into and out of contact with the surface being ground. Chatter marks induced by this bounce seem to be worse when the surface being ground is rotating away from the grinding wheel (ie when the part is not being forced/rotated onto the wheel).

SUMMARY OF THE INVENTION

According to a first aspect of the invention in a method of grinding a crankpin of a crankshaft using computer controlled wheelfeed and headstock drives, the latter serving to rotate the crankshaft and therefore rotate the pin therearound during the final grinding step, corresponding to the sparkout step of previous methods, two changes are made to the known method, namely:

(i) a cutting force is maintained during the final grinding step so that a constant force is maintained on the wheelhead to keep the wheel and pin under a moderate load during what would have been the sparkout step of the process, and (ii) during the final grinding step the rotational speed of the headstock drive (and therefore crankshaft) is reduced;

to prevent bounce and chatter marks appearing in the surface of the pin.

Typically the speed reduction of the headstock drive is in the range 1 to 5 rpm.

Typically the wheelfeed is adjusted so as to remove a sufficient depth of material during a single rotation of the crankshaft to bring the crankpin to finish size.

Preferably the pin is gauged before the final grinding step is performed, so as to determine the depth of cut which is necessary to achieve finish size and the wheelhead is controlled so as to remove the depth of metal that is necessary to achieve finish size.

Preferably the coolant supply pressure is reduced during the final single revolution of the crankshaft, so that coolant flow is significantly reduced during that final revolution so that whereas a cutting force is maintained throughout the final grind revolution, the hydrodynamic forces are reduced.

If any roundness errors on the pin are still found to exist, a computer based component-profile editing procedure may be employed to remove any such errors, since in general these residual errors will tend to be the same and will appear on each pin on every shaft ground.

Thus in one example of this first aspect of the invention, the majority of the metal to be removed to grind a steel crankpin to size using a CBN wheel, is removed in the traditional manner, and as the pin approaches finish size and only approximately 50 $\mu$m is left on the radius to be removed, the pin is gauged and the precise oversize determined, the workspeed is decreased to 3 rpm, the coolant supply is reduced and the wheelhead is controlled so as to remove a final depth increment, the size of which is determined by the gauging, from around the pin, during a single revolution of the crankshaft, after which the wheelhead is retracted so that the wheel disengages completely from the pin, without a sparkout step, leaving the pin ground to size.

According to a further refinement, in a method of grinding crankpins of a crankshaft using a CBN wheel, the wheel speed of rotation is varied at intervals during the grinding of the pins so as to reduce the uneven wear pattern which can otherwise occur around the grinding surface of the wheel.

It has been found that a wheel can become worn in some places more than others around its circumference. This seems to arise due to any out of balance of the wheel. This imbalance is believed to set up a vibration at a particular frequency, causing spaced apart regions around the wheel to wear more than others, so as to produce what is described as a lobe effect on the grinding wheel. This in turn has been found to be one of the causes of regenerative chatter.

According to this aspect of the invention, the wheel speed may be changed after every nth pin has been ground.

Typically n equals 3. but can be any value from 1 upwards.

Typically the rotational speed change is of the order of ±2–5% of the nominal wheel speed.

By changing the wheel speed, so the positions of points at which wear can occur as aforesaid will alter so that any extra wear on the grinding wheel will occur at different places around the circumference of the wheel, instead of always in the same places, during each revolution of the wheel.

In a method incorporating one or other or all of the aspects of the invention disclosed herein, a gauge may be used to measure the pin when the latter is expected to be 100 m above finish size; and a computer is programmed to adjust at least the wheel feed based on the gauged size of the pin, to ensure the correct depth of cut during the final grind before grinding is recommenced.

The invention also lies in a method as aforesaid when used to grind the crankpin of a steel crankshaft of a large (ie 6 cylinder) diesel engine.

The invention also lies in apparatus for performing the crankpin grinding methods described above.

The invention will now be described by way of example with reference to the accompanying drawings:

In the drawing the main frame of a grinding machine is shown at 10.

A first slideway 12 carried by the frame supports a worktable 14 slidable therealong, and adjustable from one position to another to the extent permitted by the length of the slideway, by a worktable drive motor 16.

A second slideway 18 parallel to the first, carries a workhead (headstock) 20 and a tailstock 22 having a workpiece holder 23. Rotation of a workpiece (such as a crankshaft or camshaft—not shown) mounted between headstock 20 and tailstock 22 is effected by a headstock drive (motor) 24, the rotation of which is transmitted to the workpiece via a chuck or other workpiece holding and driving device 26. The angular position and speed of rotation of the drive motor (and therefore workpiece) is measured by signals from a tachogenerator 28.

Conveniently the drive motor 24 is a stepper motor to allow the workpiece to be angularly position very precisely.

Movement of the headstock 20 and tailstock 22 along the sideway 18 is effected by drives 30, 32 respectively. Where as is usual the workstock 20 is fixed to the worktable 14, the drive motor 30 can be dispensed with.

A grinding wheel 34 is mounted on the drive shaft of a motor 36 itself secured to a wheelhead 38 which is slidable along a third slideway 40, which extends perpendicularly to the slideways 12 and 18, and therefore also to the workpiece axis-denoted by reference numeral 42.

Movement of the wheelhead 38, along 40, is controlled by a linear electromagnetic drive shown dotted at 44 and hydrostatic bearings are typically employed between the slideway 40 and the wheelhead 38.

Power to the motors 16, 24, 30, 32, 36 and 44 is provided from a combined power supply and computer based control unit 46, and power feeds and control signal highways are shown diagrammatically at 48 (for wheel drive 36), 50 (for wheelhead drive 44), 52 (for worktable drive motor 16), 54 (for tailstock positioning drive 32), 56 (for headstock position drive 30), and 58 (for workpiece drive motor 24).

Signals indicating the workpiece speed for tachogenerator 28 are supplied to 46 via 60 and signals to and from a gauge 62, are conveyed via highway 64. The gauge 62 consists of a support gantry 66, head 68 and gauging calliper 70, the gantry being mounted to the wheelhead to move therewith. Although not shown the gantry includes additional drive means for extending and retracting the head 68 relative to the workpiece and the head may include drive means for moving the calliper relative to the head and the workpiece.

Signals for controlling the movement and positioning of the gantry, head and calliper and signals indicative of the diameter of a gauged part, are conveyed to and from 46 as appropriate along the highway designated 64.

By entering a suitable instruction set/program into the computer within 46, so the machine can be set to grind a workpiece mounted between 26 and 28 and to gauge the diameter of the ground region of the workpiece shortly before final size is obtained. Thereafter the computer controls the wheelfeed drive 38 to maintain an appropriate cutting force (to achieve a desired depth of cut) and to reduce the speed of workpiece drive motor 24. In general it has been found desirable and possible to control the motor to rotate the workpiece only once after the gauging, by controlling the desired depth of cut to be such as to remove in a single revolution just the required depth of metal to leave the region at the desired finish-size. The wheel can then be withdrawn from engagement completely, as opposed to leaving it in grazing contact to perform a sparkout step, which is no longer required.

Coolant fluid is supplied via nozzle 72 from a pump (not shown), and a valve 74 controls the flow of coolant to the nozzle and may merely restrict the flow or direct more or less of the flow back to a reservoir from which it is drawn by the pump. Operation of the valve 74 is also under control of computer generated signals from 46 and power and control signals are supplied to the valve 74 along highway 76.

In accordance with the method herein described, the flow of coolant is reduced at least during a final revolution of the workpiece in a grinding operation performed on a region thereof, so as to reduce the hydrodynamic forces on the workpiece during that final revolution.

What is claimed is:

1. A method of grinding a crankpin of a crankshaft using a grinding machine having computer controlled wheelfeed for a grinding wheel mounted on a wheelhead and headstock drives, the headstock drive serving to rotate the crankshaft and therefore rotate the crankpin, wherein a final grinding process leading to finish size comprises the steps of:

1) maintaining a cutting force on the wheelhead to keep the wheel and pin under a moderate constant load;

2) reducing the rotational speed of the headstock drive thereby reducing the rotational speed of the crankshaft and the crankpin; and 3) eliminating a sparkout step in which the crankshaft continues to rotate while wheelfeed is stopped, whereby bounce and chatter marks appearing on the surface of the pin are prevented.

2. A method as claimed in claim 1, wherein the rotational speed of the headstock drive during step 2) of the final grinding process is in the range 1 to 5 rpm.

3. A method as claimed in claim 1, wherein during the final grinding process the wheelfeed is adjusted so as to remove a sufficient depth of material during a single rotation of the crankshaft, to bring the crankpin to finish size.

4. A method as claimed in claim 1 further comprising the steps of:

1) gauging the pin before the final grinding process is performed;

2) determining the depth of cut which is necessary to achieve finish size; and 3) controlling the wheelfeed to remove the depth of metal that is necessary to achieve that finish size during a single rotation of the crankshaft.

5. A method as claimed in claim 1, further comprising the steps of:

1) supplying coolant to the grinding wheel; and 2) reducing the coolant flow rate during the final grinding process.

6. A method as claimed in claim 1, wherein after grinding each pin the crankshaft is indexed axially so as to align the next pin to be ground with the wheel.

7. A method of grinding a crankpin of a crankshaft using a CBN wheel in a grinding machine having computer controlled wheelfeed and headstock drives, the wheelfeed drive advancing a grinding wheel into a crankpin and the headstock drive rotating the workpiece during grinding, wherein the majority of the metal to be removed to grind a steel crankpin to size is removed by feeding the grinding wheel into the pin, and as the pin approaches finish size and only approximately 50 um is left on the radius to be removed, the pin is gauged and the precise oversize determined, the workspeed is decreased to a speed in the range 1–5 rpm, the coolant flow rate is reduced, and the wheelfeed is controlled so as to remove from around the pin during a single revolution of the crankshaft a final depth increment, the size of which is determined by the gauging, after which the wheelhead is retracted so that the wheel disengages completely from the pin, without a sparkout step, leaving the pin ground to size.

8. A method as claimed in claim 7, wherein after grinding each pin the crankshaft is indexed axially so as to align the next pin to be ground with the wheel.

9. A method as claimed in claim 8, when using a CBN wheel, wherein the wheel speed of rotation is varied at intervals during the grinding of the pins.

10. A method as claimed in claim 9, wherein the wheel speed is changed after the nth pin has been ground.

11. A method as claimed in claim 10, wherein n equals 3.

12. A method as claimed in claim 9, wherein the rotational speed change is of the order of ±2–5% of the nominal wheel speed.

13. A method as claimed in claim 12, wherein the method is applied to the crankpin of a steel crankshaft such as is employed in a large diesel engine.

* * * * *

UNITED STATES PATENT AND TRADEMARK OFFICE

CERTIFICATE OF CORRECTION

PATENT NO. : 6,767,273 B1
DATED : July 27, 2004
INVENTOR(S) : Coverdale et al.

It is certified that error appears in the above-identified patent and that said Letters Patent is hereby corrected as shown below:

Title page,
Item [57], ABSTRACT, last line, after "gauged" insert therein -- before the final grinding step is performed to determine the depth of cut necessary to achieve finish size. --
Item [74], *Attorney, Agent, or Firm*, after "P.C." delete "P.C."
Item [75], Inventors, after "Thomas" delete "Proctor" and insert therein -- Procter --

Column 1,
Line 48, after "115m/s" insert therein -- . --
Line 49, after "42mm" insert therein -- . --

Column 3,
Line 29, after "3" delete "."
Line 40, after "100" delete "m" and insert therein -- um --

Column 5,
Line 34, after "reducing" delete "the"

Signed and Sealed this

Twenty-eighth Day of December, 2004

JON W. DUDAS
*Director of the United States Patent and Trademark Office*